US005082394A

United States Patent [19]

George

[11] Patent Number: 5,082,394

[45] Date of Patent: Jan. 21, 1992

[54] EXPANSION JOINT SEALS AND METHODS AND APPARATUS FOR MAKING AND INSTALLING THE SAME

[76] Inventor: Joseph D. George, 1263 Royal York Road, Islington, Ontario, Canada, M9A 4C4

[21] Appl. No.: 517,671

[22] Filed: May 2, 1990

[30] Foreign Application Priority Data

May 4, 1989 [CA] Canada ..... 598907

[51] Int. Cl.[5] ..... E01C 11/02; E01C 11/08

[52] U.S. Cl. ..... 404/68; 404/67; 404/57

[58] Field of Search ..... 404/56-58, 404/47, 67, 68

[56] References Cited

U.S. PATENT DOCUMENTS

| | | | |
|---|---|---|---|
| 2,203,078 | 6/1940 | Carter | 404/57 X |
| 2,628,544 | 2/1953 | Miller | 404/56 X |
| 2,976,782 | 3/1961 | Thom | 404/47 |
| 3,758,220 | 9/1973 | Hern | 404/67 |
| 3,899,261 | 8/1975 | Mieville | 404/68 |
| 3,992,121 | 11/1976 | Geiger | 404/47 |
| 4,279,533 | 7/1981 | Peterson et al. | 404/68 |
| 4,307,974 | 12/1981 | George | 404/68 |
| 4,569,615 | 2/1986 | Goldman et al. | 404/68 X |
| 4,576,510 | 3/1986 | Ljungkvist et al. | 404/68 |
| 4,784,516 | 11/1988 | Cox | 404/67 X |
| 4,893,448 | 1/1990 | McCormick | 404/68 X |

FOREIGN PATENT DOCUMENTS

| | | |
|---|---|---|
| 784949 | 5/1968 | Canada . |
| 790323 | 7/1968 | Canada . |
| 793015 | 8/1968 | Canada . |
| 796962 | 10/1968 | Canada . |
| 884661 | 11/1971 | Canada . |
| 957887 | 11/1974 | Canada . |
| 971794 | 7/1975 | Canada . |
| 1001876 | 12/1976 | Canada . |
| 1007913 | 4/1977 | Canada . |
| 1011976 | 6/1977 | Canada . |
| 1017983 | 9/1977 | Canada . |
| 1108911 | 9/1981 | Canada . |
| 1123644 | 5/1982 | Canada . |
| 1128354 | 7/1982 | Canada . |

*Primary Examiner*—Ramon S. Britts
*Assistant Examiner*—Nancy P. Connolly
*Attorney, Agent, or Firm*—Finnegan, Henderson, Farabow, Garrett & Dunner

[57] ABSTRACT

An expansion joint seal for sealing the gap between adjacent deck members of a bridge, for example, includes a strip of elastomeric material having an expansion portion and side marginal portions. According to one aspect of the invention, the expansion portion is reinforced with one-way fabric. According to another aspect of the invention, the side marginal portions are reinforced with two-way fabric. According to a third aspect of the invention, prefabricated bed plate assemblies are provided with mounting members on which an expansion joint seal can be mounted, the bed plate assemblies being capable of being readily secured to the edges of the adjacent deck members.

37 Claims, 4 Drawing Sheets

FIG. 3

| SIZE | MAX. SPAN | MAX. OPENING | MAX. CLOSING | SEAL WIDTH |
|---|---|---|---|---|
| 1A | 61 M (200 FT) | 83 MM (3.25 INCHES) | 39 MM (1.5 INCHES) | 305 MM (12 INCHES) |
| 1B | 76 M (250 FT) | 102 MM (4.0 INCHES) | 32 MM (1.25 INCHES) | 355 MM (14 INCHES) |
| 1C | 107 M (350 FT) | 127 MM (5.0 INCHES) | 25 MM (1 INCH) | 406 MM (16 INCHES) |
| 1D | 137 M (450 FT) | 147 MM (5.8 INCHES) | 19 MM (3/4 INCH) | 457 MM (18 INCHES) |

EXPANSION JOINT SEALS AND METHODS AND APPARATUS FOR MAKING AND INSTALLING THE SAME

BACKGROUND OF THE INVENTION

This invention in one aspect relates to an expansion joint seal, which may have various forms, for sealing the gap between two spaced apart members, the seal bridging this gap. The invention has wide application in the sealing of gaps between adjacent deck sections on bridges or the like but also may be used elsewhere. In another aspect this invention relates to techniques, methods and apparatus for making and installing expansion joint seals.

The sealing of the gap between adjacent deck sections of a bridge is very important to the maintenance of the bridge. The seal must allow movement of the deck sections and, thus, must be capable of expansion and contraction as the gap across which it bridges expands and contracts due to expansion and contraction of the deck sections caused by temperature changes. The seal must prevent water, salt and other foreign material from seeping down into the metal parts beneath the bridge decks where it may cause damage to the bearings and other mechanisms associated with bridge expansion, and corrosion of bridge components. The seal also must bridge the gap in such a fashion as to provide a smooth crossing for vehicles.

Many expansion joint seals have been developed, some using reinforced elastomer materials and others using intermeshing metallic elements.

A particularly effective expansion joint seal is described and claimed in Canadian Patent 884,661, Joseph D. George, issued Nov. 2, 1971. The present invention in certain aspects thereof constitutes an improvement to the expansion joint seal disclosed in this patent. Other aspects of this invention relate to expansion joint seals which are not necessarily of the type disclosed in Canadian Patent 884,661.

OBJECTS OF VARIOUS ASPECTS OF THE INVENTION

It is an object of an aspect of the invention to provide an expansion joint seal which, while allowing movement of the two members between which the seal is located, prevents water, salt and other foreign material from passing between the gap between these two members.

It is an object of an aspect of the invention to provide an expansion joint seal for a bridge or the like that provides a smooth ride, which absorbs vibration and which reduces pavement cracking by reducing the transmission of vibration to the pavement.

It is an object of an aspect of the invention to provide an expansion joint seal employing an elongated strip of elastomer material which, in the expansion area of the seal, incorporates a one-way fabric to improve the stability of the elastomer, while maintaining the high resilience and low modulus of a low durometer compound and, at the same time, strengthening the upper and lower margins of channels within the elastomer within which load-bearing bars are slidably mounted.

It is an object of an aspect of this invention to provide an expansion joint seal that includes an elongated strip of elastomer material with opposed side marginal portions, the side marginal portions having two-way fabric incorporated therein to resist necking down of the side marginal portions during expansion of the strip as the gap bridged by the strip widens.

It is an object of an aspect of the invention to provide an expansion joint seal which can be quickly and simply installed in place with the correct degree of expansion or contraction of the expandable part of the seal regardless of the spacing between the two members the gap between which is to be sealed.

SUMMARY OF THE INVENTION

Various aspects of this invention are as follows:

An expansion joint seal comprising an elongated strip of elastomer material with opposed side marginal portions each adapted to be secured in place with respect to spaced apart members between which there is a gap adapted to be bridged by said seal, said strip being formed with a series of spaced apart transversely extending openings each having an upper margin and a lower margin, a plurality of load-bearing members, said openings receiving said load-bearing members in such a manner that said load-bearing members may slide within said openings, said load-bearing members being sufficient length that, in use, said load-bearing members extend across said strip to the extent that the ends of said load-bearing members overlie said spaced apart members, and at least first and second layers of one-way fabric disposed within said elastomer material, one of said layers being located adjacent said upper margin and the other of said layers being located adjacent said lower margin positioned for engagement with said load bearing members while sliding, said one-way fabric having cords therein substantially all of which run in the same direction, said direction being substantially parallel to said side marginal portions, whereby said cords do not inhibit expansion of said strip as said gap widens.

An expansion joint seal for bridging a gap between two spaced apart members, said seal including prefabricated first and second members each having mounting means thereon, said first and second members with said mounting means thereon each being secured to a different one of said spaced apart members at a predetermined spacing between said mounting means of said first member and said mounting means of said second member, an elongated strip of expansible material mounted on said mounting means and bridging said gap, and means for securing said strip to said first and second members.

A method for making an expansion joint seal for bridging a gap between two spaced apart members which comprises providing first and second members each having mounting means thereon, securing said first and second members to different ones of said spaced apart members with a predetermined spacing between said mounting means of said first member and said mounting means of said second member, mounting an elongated strip of expansible material on said mounting means and bridging said gap, and securing said strip to said first and second members.

BRIEF DESCRIPTION OF THE DRAWINGS

This invention will become more apparent from the following detailed description, taken in conjunction with the appended drawings in which:

FIGS. 3 and 4 are a table and a graph respectively useful in the selection and installation of an expansion joint seal embodying the present invention.

DETAILED DESCRIPTION OF THE INVENTION INCLUDING THE PREFERRED EMBODIMENT

Figure 1:
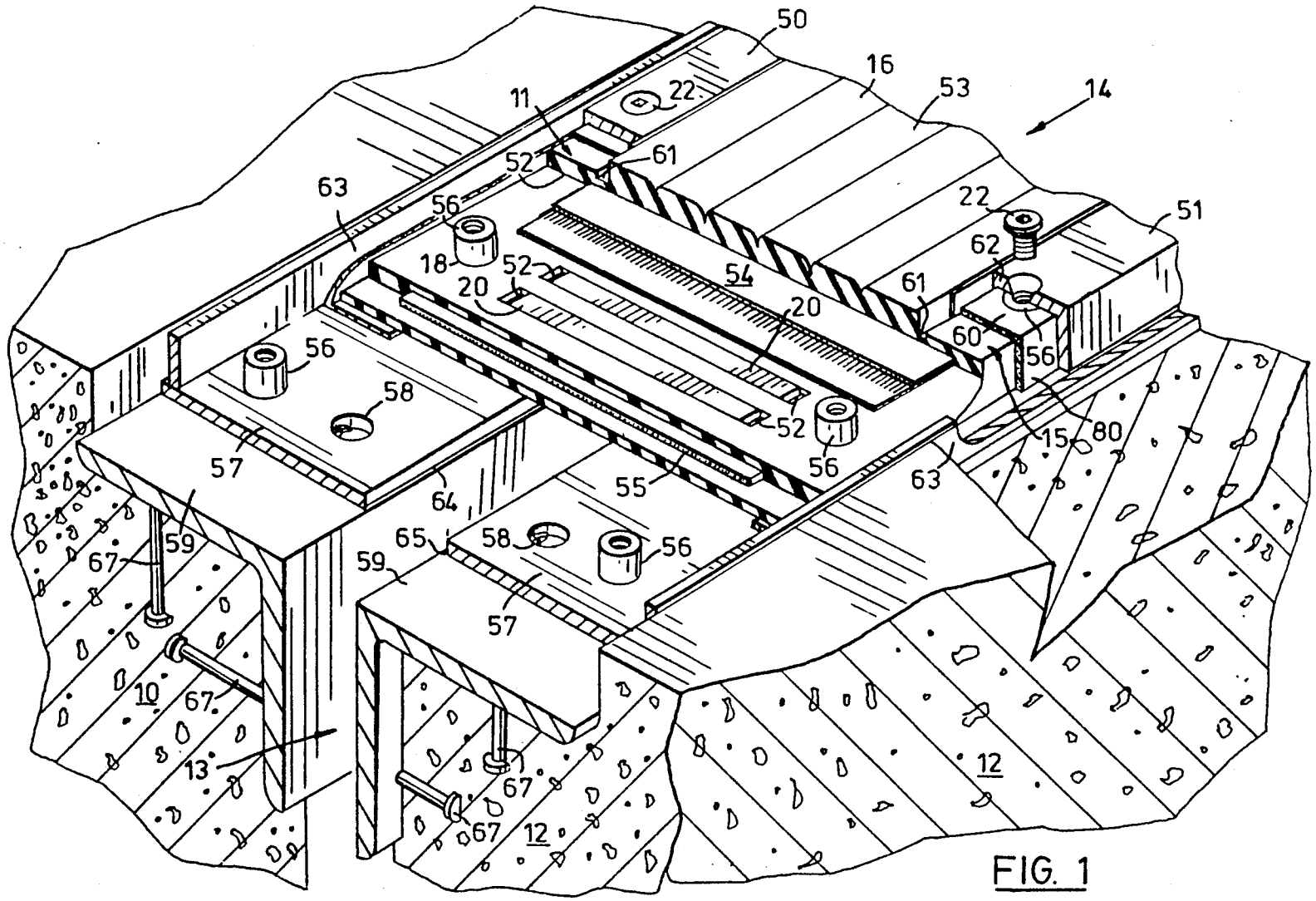
FIG. 1 is a perspective view, partly broken away, showing an expansion joint seal embodying the present invention.

The aspect of the present invention which is an improvement on the expansion joint seal described in Canadian Patent 884,661 first will be described. In this connection, and referring to FIGS. 1 and 2, the numerals 10 and 12 refer to adjacent deck members or panels of a bridge deck. They commonly are constructed of concrete or steel, and the gap 13 between them must be sealed in order to prevent water, snow, salt and other foreign material and objects passing from the top of the deck Via gap 13 onto the bridge members and bearings beneath the deck. Sections 10 and 12 must be spaced apart to allow for expansion of the deck sections due to changes in temperature.

An expansion joint seal according to an aspect of this invention is generally indicated by reference numeral 14. It comprises an elongated strip 16 of rubber or other like elastomer material and has opposed side marginal portions 11 and 15 which are adapted to be secured in place with respect to deck members 10 and 12 Hold-down members or angles 50 and 51 fabricated of a strong, corrosion-resistant metal are adapted to be fastened to opposed side marginal portions 11 and 15 in a manner to be outlined in greater detail hereinafter.

Within strip 16 there are a plurality of slots or channels 52 spaced apart from each other lengthwise of strip 16. Within each channel 52 is a load-bearing member 20, Which may be in the form of a steel spline. Each spline 20 is somewhat less in length than the length of the channel 52 that it occupies when strip 16 is in its relaxed condition. Thus strip 16 can contract without being compressed against splines 20. However, the load-bearing members are of sufficient length that the free ends thereof overlie deck members 10 and 12, i.e., they bridge gap 13.

In accordance with this aspect of the invention, there is incorporated into the expansible part 53 of strip 16 at least two layers 54 and 55 of one-way fabric. The upper layer 54 is located adjacent the upper margin of channels 52, while the lower layer 55 is located adjacent the lower margin of channels 52. The one-way fabric has cords therein substantially all of which run in the same direction, this direction being substantially parallel to side marginal portions 11 and 15, as a result of which the cords do not inhibit expansion of strip 16 in its expansible part 53 as the gap 13 bridged by expansion joint seal 14 widens. Upper and lower layers 54 and 55 of one-way fabric facilitate the sliding of load-bearing members 20 in channels 52, keep members 20 in their respective channels 22 and prevent them from digging into the elastomeric material surrounding channels 52. Lower layer 55 serves to reinforce under load-bearing members 20 to distribute the load from the members more evenly across the expansion joint seal, and the layers 54 and 55 of one-way fabric tend to prevent members 20 from punching through the elastomeric material in use.

Many different types of one-way fabric may be used without departing from the instant invention. It is to be understood that a one-way fabric is one which is composed primarily of cords which all run in substantially the same direction. There may be several tie cords running perpendicular to the main body of the cords, but these serve merely to hold the main body of the cords in place and offer very little resistance to transverse displacement of adjacent ones of the main cords. In a preferred embodiment of this invention each one-way fabric layer 54 and 55 employs polyester cords, the bare fabric having a gauge of 0.035 inches and being coated on both sides with rubber to a finished thickness of 0.05 inches, but this is strictly exemplary and in no way restrictive.

Hold down bolts 22 extend through hold-down members 50 and 51 at spaced apart locations along the length of strip 16 and threadably engage spaced apart mounting members in the form of internally threaded ferrules 56 that are integral with, mounted on or otherwise secured to elongated bed plates 57 of heavy gauge metal. Bed plates 57 are provided with openings 58 at various locations therealong, at which locations bed plates 57 may be plug welded to angle irons 59 that are securely fastened to deck members 10 and 12 by means of anchor studs 67.

Side marginal portions 11 and 15 are provided with openings 60 therein at spaced apart locations corresponding to the spacing of ferrules 56. Ferrules 56 fit into openings 60, and bolts 22, by virtue of threadable engagement with ferrules 56, hold strip 16 in position with opposed side marginal portions 11 and 15 being sandwiched between hold-down members 50 and 51 and bed plates 57.

Figure 2:
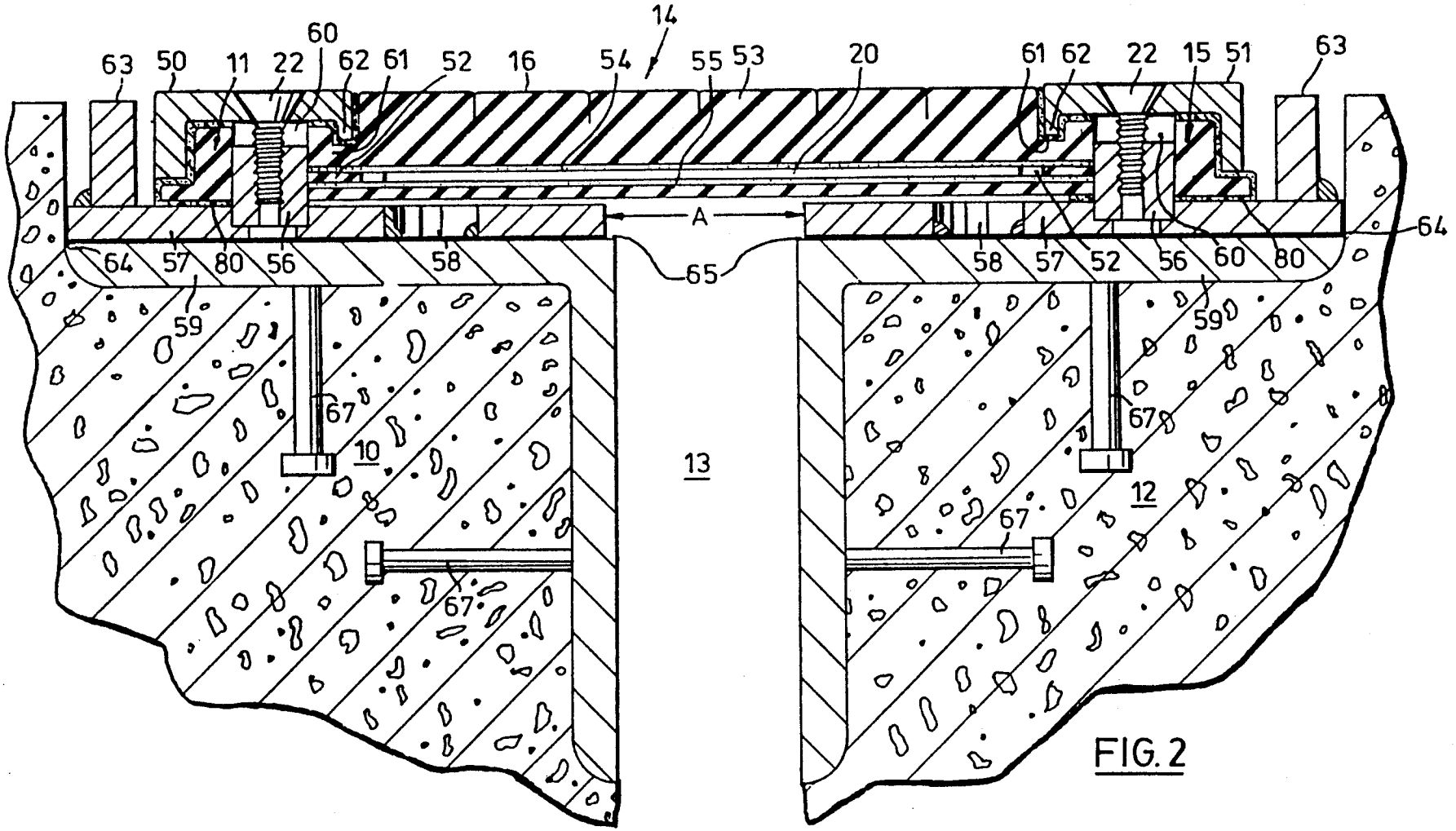
FIG. 2 is a section through the expansion joint seal of FIG. 1.

It is to be understood, of course, that the embodiment of the invention illustrated in FIGS. 1 and 2 merely is a preferred embodiment of the invention and, insofar as the aspect of this invention involving the incorporation into expansible part 53 of layers of one-way fabric is concerned, this aspect of the invention is in no way restricted to the technique and apparatus shown in FIGS. 1 and 2 for securing strip 16 in position.

Strip 16 in use will have a thickness depending upon the size of the expansion joint seal in the structure. The wider the expansion joint seal, the thicker it will be. Strip 16 may be in a relaxed condition, contracted or expanded depending upon the ambient temperature and the size of gap 13, all as is disclosed more fully in conjunction with FIG. 4. Load-bearing members 20 are adapted to support loads passing over the deck members and, in the case of a bridge, must be strong enough to support automobile and truck traffic.

Load-bearing members 20 are freely moveable within their channels 52 so that as the space between deck members 10 and 12 varies with changes in temperature, load-bearing members 20 are free to slide with respect to the elastomeric strip that houses them. It will be noted that the free ends of members 20 overlie spaced apart deck members 10 and 12. It will be noted that the expansion of adjacent deck members 10 and 12 is uniformly distributed over the full width of the strip 16 of elastomeric material.

Strictly by way of example, for an expansion joint seal of size IA (FIG. 3), slots 52 may be 7" long, 1" wide and 3/16" thick and spaced on 2" centers. Steel splines 20 may be of the same width and thickness but 6½" long.

Other forms of load-bearing members which may be used are shown in aforementioned Canadian Patent 884,661.

The operation of the expansion joint seal 14 hereinbefore described and illustrated should be readily apparent from the foregoing description. In any event, strip 16 expands and contracts in region 53 as adjacent deck members 10 and 12 move towards and away from each other due to changes in climatic conditions and settling conditions of the bridge or the like. As this occurs, load-bearing members 20 slide in their respective channels 52 and are constrained to slide within these channels by one-way fabric layers 54 and 55 which also serve to reinforce region 53 of strip 16, more evenly distribute the load from members 20 over strip 16 and inhibit members 20 from punching out of their channels 52 into the surrounding elastomeric material of strip 16.

Another aspect of this invention involves side marginal portions 11 and 15. As best shown in FIG. 2, each side marginal portion 11 and 15 is separated from expansible part 53 by a channel 61. These channels 61 receive downwardly turned fingers 62 provided on hold-down members 50 and 51. Hold-down members 50 and 51 serve to hold side marginal portions 11 and 15 in place during expansion and contraction of expansible part 53, but side marginal portions 11 and 15 also are subjected to stretching or a tendency to neck down as expansible part 53 expands. This necking down may cause the depth of side marginal portions to decrease and, to the extent that this occurs in the region of fingers 62, there may be a tendency for side marginal portions 11 and 15 to pull out from under hold-down members 50 and 51. In order to inhibit this, and in accordance with another aspect of this invention, a plurality of cords of material are incorporated into side marginal portions 11 and 15, some of the cords running in one direction and others running in a direction substantially perpendicular to the first-mentioned direction. These cords resist necking down of side marginal portions 11 and 15 during expansion of strip 16 in region 53 as the gap between deck members 10 and 12 widens.

In the preferred embodiment of this aspect of the invention the aforementioned cords are incorporated into a two-way fabric 80, i.e., a fabric composed of cords that run in at least substantially perpendicular directions such that the cords resist elongation in either of these directions. One such two-way fabric which may be used in the practice of this aspect of the invention employs nylon cords and has a bare fabric thickness of 0.034 inches, the fabric being coated on both sides with rubber to a finished thickness of 0.065 inches. This is strictly exemplary however.

In the preferred embodiment of this invention two-way fabric 80 is incorporated into the surface of side marginal portions 11 and 15 within channels 61, across the top and bottom of each side marginal portion 11 and 15 and along the side of each side marginal portion 11 and 15, all as shown in FIG. 2. Satisfactory results probably can be achieved, however, simply by incorporating two-way fabric 80 into the upper region of each side marginal portion 11 and 15 where it will have the effect of rigidifying the upper surface of each side marginal portion 11 and 15 and preventing pull out from under fingers 62.

Those skilled in the art will appreciate that this second aspect of the invention is in no way dependant upon an expansion joint seal having load-bearing members 20 within strip 16, and, according to this aspect of the invention, expansible part 53 of strip 16 may be quite different from what has been hitherto disclosed and may or may not have channels 52 and load-bearing members 20 incorporated therein.

It will be apparent from the foregoing that, in accordance with this second aspect of the invention, the addition of two-way fabric layers 80 to side marginal portions 11 and 15 improves the rigidity of the elastomer in these areas, giving it better resistance to pull-out, stretching and tear.

Those skilled in the art also will appreciate that in a preferred embodiment of this invention an expansion joint seal of the type disclosed in Canadian Patent 884,661 is modified by the inclusion of one-way fabric layers 54 and 55 in expansible part 53 of the expansion joint seal, all as hereinbefore described and by incorporating two-way fabric 80 or the like into side marginal portions 11 and 15.

A third aspect of this invention now will be disclosed with reference to FIGS. 1 and 2. This third aspect of the invention is not dependant upon employing a strip 16 of elastomeric material of the type hereinbefore described in connection with the first aspect of the invention, although, this would be preferred, of course.

The third aspect of the invention deals with mounting of the seal member proper on deck members 10 and 12 and bridging gap 13.

In the past, one technique for accomplishing this has been to weld or otherwise secure mounting members, e.g., internally threaded ferrules at spaced apart locations along the upper surfaces of angle irons 59. Care had to be taken to ensure that all of these ferrules were longitudinally spaced apart from each other by precisely the same distance, this distance being precisely the same distance as the spacing of openings provided in the opposed side marginal portions of the strip to be used to bridge the gap between adjacent deck members. Moreover, each ferrule on adjacent angle irons had to be precisely aligned with another ferrule on the angle iron of the other deck member, or it would be impossible to place the bridging strip member in location over the mounting ferrules.

According to a third aspect of this invention, this whole problem has been overcome by the provision of prefabricated bed plates 57 having mounting members 56, which may be in the form of internally threaded ferrules, precisely factory located on bed plates 57 in precisely the same location as openings 60 in side marginal portions 11 and 15.

In order to install the expansion joint seal it is only necessary to fasten bed plates 57, as by plug welding, for example, to angle irons 59 with the proper spacing between ferrules 56 on the spaced apart bed plates. This required spacing will depend upon the size of gap 13 between deck members 10 and 12 which, in turn, depends upon the temperature.

Figure 4:
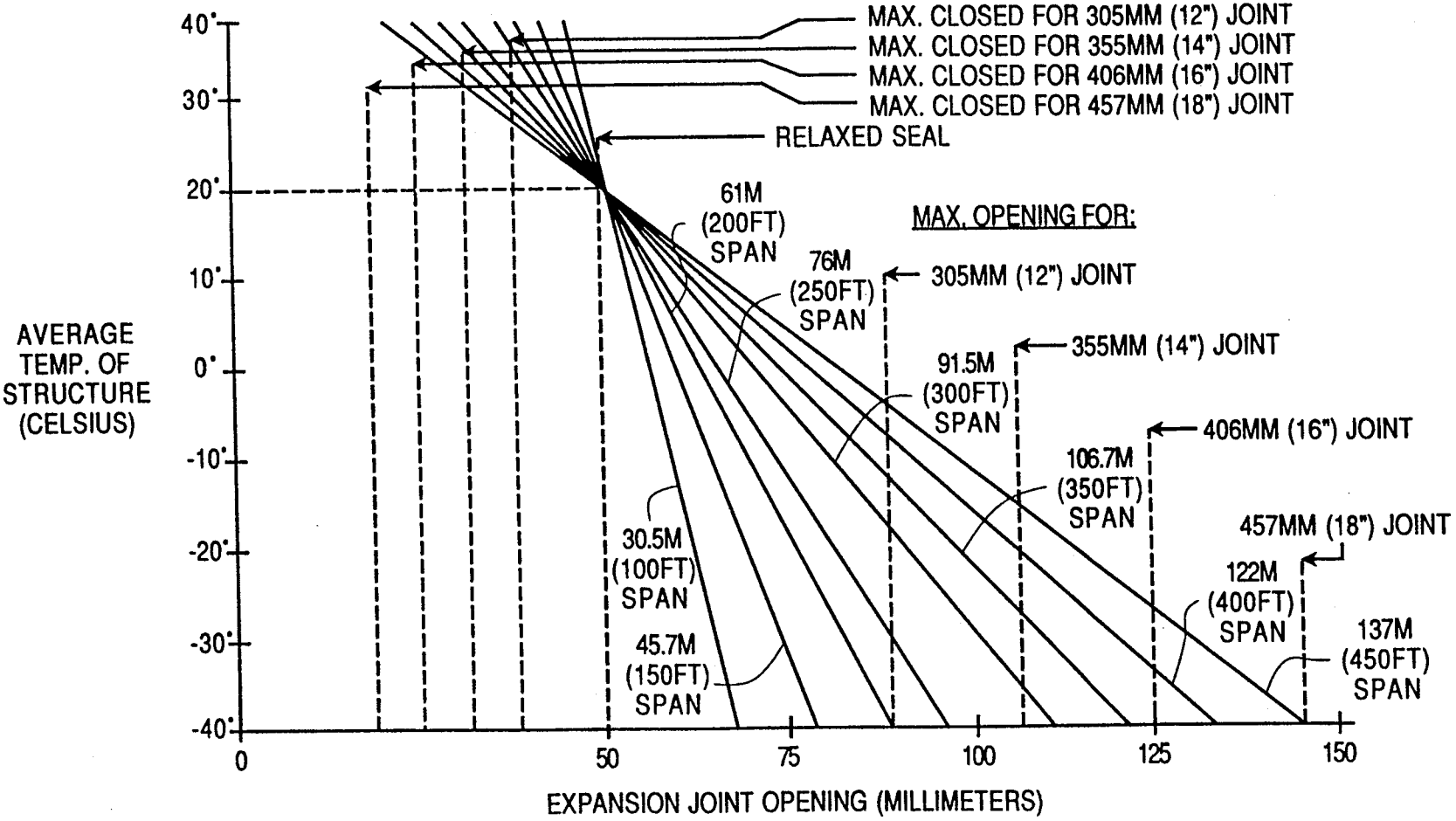

Shown in FIG. 4 is a movement chart which, for various spans, shows precisely the required expansion joint opening at various temperatures.

Shown in FIG. 3 is a specification chart for expansion joint seals of various widths.

Strictly by way of example, and assuming a temperature of 20° C., it will be seen from FIG. 4 that bed plates 57 should be installed with an expansion joint opening (shown in FIG. 2 by the dimension A) of 50 millimeters therebetween regardless of the width of the seal. However, at a temperature of 0° C. and for a three hundred foot span, the expansion joint opening should be about 70 millimeters.

Once bed plates 57 with their associated ferrules have been properly located with the correct expansion joint opening therebetween and secured to angle irons 59, all that is necessary simply is to place strip 16 over bed plates 57 with ferrules 56 inserted in openings 60 in side marginal portions 11 and 15. This provides a quick, simple, easy and accurate technique for installation of the expansion joint seal. Any appropriate means then may be used to secure strip 16 in position, e.g. hold-down members 50 and 51 and hold-down bolts 52, but this aspect of the invention is not restricted to this form of securing. It will be understood that the size of bed plates 57 will change with the size of the expansion joint seal, the bed plates for a 1D seal being larger than for a IA seal.

In a preferred embodiment of this aspect of the invention each bed plate 57 is provided with a dam plate 63, which is simply a metal plate welded or otherwise fastened to each bed plate 57 and projecting vertically upwardly therefrom. The space between each dam plate 63 and the adjacent asphalt and the space between each dam plate 63 and hold-down member 50 or 51 may be filled with any suitable waterproof sealer. Each dam plate 63 serves as a vibration isolator preventing vibration of the expansion joint seal due to passage of traffic over it from being transmitted to the adjacent asphalt or pavement, and thereby inhibits breaking up of the adjacent asphalt or pavement.

It should be noted that in addition to being plug welded to angle irons 59, bed plates 57 may be edge welded to angle irons 59 at locations 64 and 65.

Bed plates 57, dam plates 63 and ferrules 56 preferably are fabricated of steel, which may be CSA Can. 3.G40.21-M81 Grade 300W, although this is by no means to be construed as restrictive.

Hold-down members 50 and 51 may be of aluminum alloy such as 6061T6.

Hold-down bolts 22 may be $\frac{5}{8}$ inches by 1 and $\frac{1}{4}$ inches.

While various aspects of this invention have been disclosed herein, those skilled in the art will appreciate that changes and modifications may be made therein without departing from the spirit and scope of this invention as defined in the appended claims.

The embodiments of the invention in which an exclusive property or privilege is claimed are defined as follows:

1. An expansion joint seal comprising an elongated strip of elastomer material with opposed side marginal portions each adapted to be secured in place with respect to spaced apart members between which there is a gap adapted to be bridge by said seal, said strip being formed with a series of spaced apart transversely extending openings each having an upper margin and a lower margin, a plurality of load-bearing members, said openings receiving said load-bearing members in such a manner that said load-bearing members may slide within said openings, said load-bearing members being of sufficient length that in use, said load-bearing members extend across said strip to the extent that the ends of said load-bearing members overlie said spaced apart members, and at least first and second layers of one-way fabric disposed within said elastomer material, one of said layers being located adjacent said upper margin and the other of said layers being located adjacent said lower margin positioned for engagement with said load bearing members while sliding said one-way fabric having cords therein substantially all of which run in the same direction, said direction being substantially parallel to said side marginal portions, whereby said cords do not inhibit expansion of said strip as said gap widens.

2. An expansion joint seal according to claim 1 wherein said cords are of polyester material.

3. An expansion joint seal according to claim 1 wherein said one-way fabric is rubber coated.

4. An expansion joint seal according to claim 1 wherein said one-way fabric comprises cords of polyester material that have been rubber coated.

5. An expansion joint seal according to claim 1 including hold-down means for engaging said side marginal portions, and a plurality of cords of material incorporated into said side marginal portions, at least some of said cords running in one direction and at least some others of said cords running in a direction substantially perpendicular to said one direction, said cords resisting necking down of said side marginal portions during expansion of said strip as said gap widens.

6. An expansion joint seal according to claim 5 wherein said plurality of cords of material incorporated into said side marginal portions are in the form of at least a two-way fabric.

7. An expansion joint seal according to claim 5 wherein said hold-down means includes members overlying the upper parts of said side marginal portions and adapted to sandwich said side marginal portions between said overlying members and support members on which said side marginal portions are seated, said overlying members each having a downwardly extending finger located in a channel between said side marginal portions and the part of said elongated strip adjacent thereto, said plurality of cords of material incorporated into each said side marginal portion being located adjacent said overlying members and said fingers.

8. An expansion joint seal according to claim 5 wherein said hold-down means includes members overlying the upper parts of said side marginal portions and adapted to sandwich said side marginal portions between said overlying members and support members on which said side marginal portions are seated, said overlying members each having a downwardly extending finger located in a channel between said side marginal portions and the part of said elongated strip adjacent thereto, said plurality of cords of material incorporated into each said side marginal portion being located at the surfaces of said side marginal portions and said channels adjacent to said overlying members and said fingers respectively.

9. An expansion joint seal according to claim 6 wherein said plurality of cords of material incorporated into said side marginal portion are in the form of at least a two-way fabric.

10. An expansion joint seal according to claim 8 wherein said plurality of cords of material incorporated into said side marginal portions are in the form of at least a two-way fabric.

11. An expansion joint seal according to claim 5 wherein said plurality of cords of material incorporated into said side marginal portions are located at or adjacent to the upper, side and lower surface of each said side marginal portion.

12. An expansion joint seal according to claim 11 wherein said plurality of cords of material incorporated into said side marginal portions are in the form of at least a two-way fabric.

13. An expansion joint seal according to claim 12 wherein said two-way fabric is rubber coated nylon.

14. An expansion joint seal according to claim 1 including first and second members each having mounting means thereon, said first and second members each being adapted to be secured to a different one of said spaced apart members at a predetermined spacing between said mounting means of said first member and said mounting means of said second member, said elongated strip of elastomer being mounted on said mounting means and bridging said gap, and means for securing said strip to said first and second members.

15. An expansion joint seal according to claim 14 wherein said means for securing said strip to said first and second members includes hold-down members overlying said side marginal portions and means fastening said hold-down members to said first and second members.

16. An expansion joint seal according to claim 15 wherein said means fastening said hold-down members to said first and second members comprises means engaging both said hold-down members and said mounting means.

17. An expansion joint seal according to claim 16 wherein said mounting means are threaded ferrules.

18. An expansion joint seal according to claim 14 wherein said first and second members are secured to said spaced apart members by being welded thereto.

19. An expansion joint seal according to claim 14 wherein said means for securing said strip to said first and second members includes hold-down means for engaging said side marginal portions, said seal further including a plurality of cords of material incorporated into said side marginal portions, at least some of said cords running in one direction and at least some others of said cords running in a direction substantially perpendicular to said one direction, said cords resisting necking down of said side marginal portions during expansion of said strip as said gap widens.

20. An expansion joint seal according to claim 19 wherein said plurality of cords of material incorporated into said side marginal portions are in the form of at least a two-way fabric.

21. An expansion joint seal according to claim 19 wherein said hold-down means includes members overlying the upper parts of said side marginal portions and adapted to sandwich said side marginal portions between said overlying members and support members on which said side marginal portions are seated, said overlying members each having a downwardly extending finger located in a channel between said side marginal portions and the part of said elongated strip adjacent thereto, said plurality of cords of material incorporated into each said side marginal portion being located adjacent said overlying members and said fingers.

22. An expansion joint seal according to claim 19 wherein said hold-down means includes members overlying the upper parts of said side marginal portions and adapted to sandwich said side marginal portions between said overlying members and support members on which said side marginal portions are seated, said overlying members each having a downwardly extending finger located in a channel between said side marginal portions and the part of said elongated strip adjacent thereto, said plurality of cords of material incorporated into each said side marginal portion being located at the surface of said side marginal portions and said channels adjacent to said overlying members and said fingers respectively.

23. An expansion joint seal according to claim 21 wherein said plurality of cords of material incorporated into said side marginal portion are in the form of at least a two-way fabric.

24. An expansion joint seal according to claim 22 wherein said plurality of cords of material incorporated into said side marginal portion are in the form of at least a two-way fabric.

25. An expansion joint seal according to claim 19 wherein said plurality of cords of material incorporated into said side marginal portions are located at or adjacent to the upper, side and lower surface of each said side marginal portion.

26. An expansion joint seal according to claim 25 wherein said plurality of cords of material incorporated into said side marginal portions are in the form of at least a two-way fabric.

27. An expansion joint seal according to claim 26 wherein said two-way fabric is rubber coated nylon.

28. An expansion joint seal according to claim 25 wherein said first and second members are secured to said spaced apart members by being welded thereto.

29. An expansion joint seal for bridging a gap between two spaced apart members, said seal including prefabricated first and second members each having mounting means thereon, said first and second members with said mounting means thereon each being secured to a different one of said spaced apart members at a predetermined spacing between said mounting means of said first member and said mounting means of said second member, an elongated strip of expansible material mounted on said mounting means and bridging said gap, and means for securing said strip to said first and second members.

30. An expansion joint seal according to claim 29 wherein said strip comprises elastomeric material.

31. An expansion joint seal according to claim 29 wherein said strip comprises reinforced elastomeric material.

32. An expansion joint seal according to claim 29 wherein said strip has opposed side marginal portions, said means for securing said strip to said first and second members including hold-down members overlying said side marginal portions and means fastening said hold-down members to said first and second members.

33. An expansion joint seal according to claim 32, wherein said means fastening said hold-down members to said first and second members comprises means engaging both said hold-down members and said mounting means.

34. An expansion joint seal according to claim 33 wherein said mounting means are threaded ferrules.

35. An expansion joint seal according to claim 29 wherein said first and second members are secured to said spaced apart members by being welded thereto.

36. A method for making an expansion joint seal for bridging a gap between two spaced apart members which comprises providing first and second members each having mounting means thereon, securing said first and second members to different ones of said spaced apart members with a predetermined spacing between said mounting means of said first member and said mounting means of said second member, mounting an elongated strip of expansible material on said mounting means and bridging said gap, and securing said strip to said first and second members.

37. A method according to claim 36 wherein said first and second members are secured to said spaced apart members by being welded thereto.

* * * * *